United States Patent [19]

Rank, Jr.

[11] Patent Number: 4,694,955

[45] Date of Patent: Sep. 22, 1987

[54] DISPLAY CARTON

[76] Inventor: Kenneth A. Rank, Jr., 409 Balsam Ct., Schaumburg, Ill. 60193

[21] Appl. No.: 882,409

[22] Filed: Jul. 7, 1986

[51] Int. Cl.[4] ..... B65D 51/00

[52] U.S. Cl. ..... 206/45.29; 206/45.18

[58] Field of Search ..... 206/45.29, 45.18

[56] References Cited

U.S. PATENT DOCUMENTS

| | | | |
|---|---|---|---|
| 1,448,743 | 3/1923 | Grady | 206/45.29 |
| 1,472,953 | 11/1923 | Bamber | 206/45.29 |
| 1,534,261 | 4/1925 | Furste | 206/45.29 |
| 1,616,707 | 2/1929 | Tanner | 206/45.29 |
| 1,616,708 | 2/1927 | Tanner | 206/45.29 |
| 1,714,542 | 5/1929 | Bergstein | 206/45.29 |
| 2,649,195 | 8/1953 | Rossi et al. | 206/45.29 |
| 2,716,485 | 8/1955 | Hecker | 206/45.29 |

FOREIGN PATENT DOCUMENTS

| | | | |
|---|---|---|---|
| 106924 | 1/1943 | Sweden | 206/45.29 |
| 735242 | 8/1955 | United Kingdom | 206/45.29 |

*Primary Examiner*—Joseph Man-Fu Moy

*Attorney, Agent, or Firm*—Thomas W. Tolpin

[57] ABSTRACT

A compact, dual purpose carton provides a strong shipping and storage box and an attractive display case. The display case has an easily erectable display stand that securely supports and aesthetically displays some of the merchandise in the carton.

7 Claims, 6 Drawing Figures

DISPLAY CARTON

BACKGROUND OF THE INVENTION

This invention pertains to cardboard boxes, and more particularly, to a display carton.

Numerous products displayed in stores, such as video tapes, toys, groceries, etc. are typically shipped to the stores in cardboard boxes. At the stores, the products are tediously unpacked and removed from the boxes and stacked on a shelf, stored in a bin, or placed on a separate display stand. The boxes are subsequently collapsed and usually discarded. This procedure is cumbersome, laborious, and inefficient. It requires extra labor, extra supervision, and extra space to store and dispose the cartons. Disposal of cartons is wasteful. The use of bins, such as in discount stores, is unattractive and decreases the appeal of the merchandise. The use and replacement of separate display stands is expensive.

Over the years a variety of cartons and containers have been suggested with windows or other devices for viewing or displaying merchandise. These prior cartons and containers have met with varying degrees of success. They usually have not been, however, aesthetically appealable or successfully marketable without a display stand.

It is, therefore, desirable to provide an improved carton which overcomes most, if not all, of the preceding problems

SUMMARY OF THE INVENTION

An improved display carton provides a strong sturdy container for safe and dependable shipment of merchandise and an attractive display case and stand for displaying the merchandise shipped in the container. Advantageously, the novel display carton is easy to use, aesthetically pleasing, attractive, economical, and effective. It is simple to assemble and readily changeable from a shipping box to a display case.

To this end, the novel carton has lateral walls, end walls, and side walls, with at least one of the walls comprising a moveable display panel. Desirably, the moveable display panel is pivotable from a normally closed shipment position to an open display position. In the closed shipment position, the outer exterior surface of the display panel blocks access to the interior of the carton. In the open display position, the inner display surface of the display panel provides a wall to support and display at least some of the merchandise in the carton.

In the preferred form, the display carton provides a stable, steady, display stand, rack and easel, which extends above the top of the box to display the merchandise. Desirably, the display case has an access opening and window for viewing the remaining merchandise in the box.

A more detailed explanation of the invention is provided in the following description and appended claims taken in conjunction with the accompanying drawings

DETAILED DESCRIPTION OF THE PREFERRED EMBODIMENT

Figure 1:
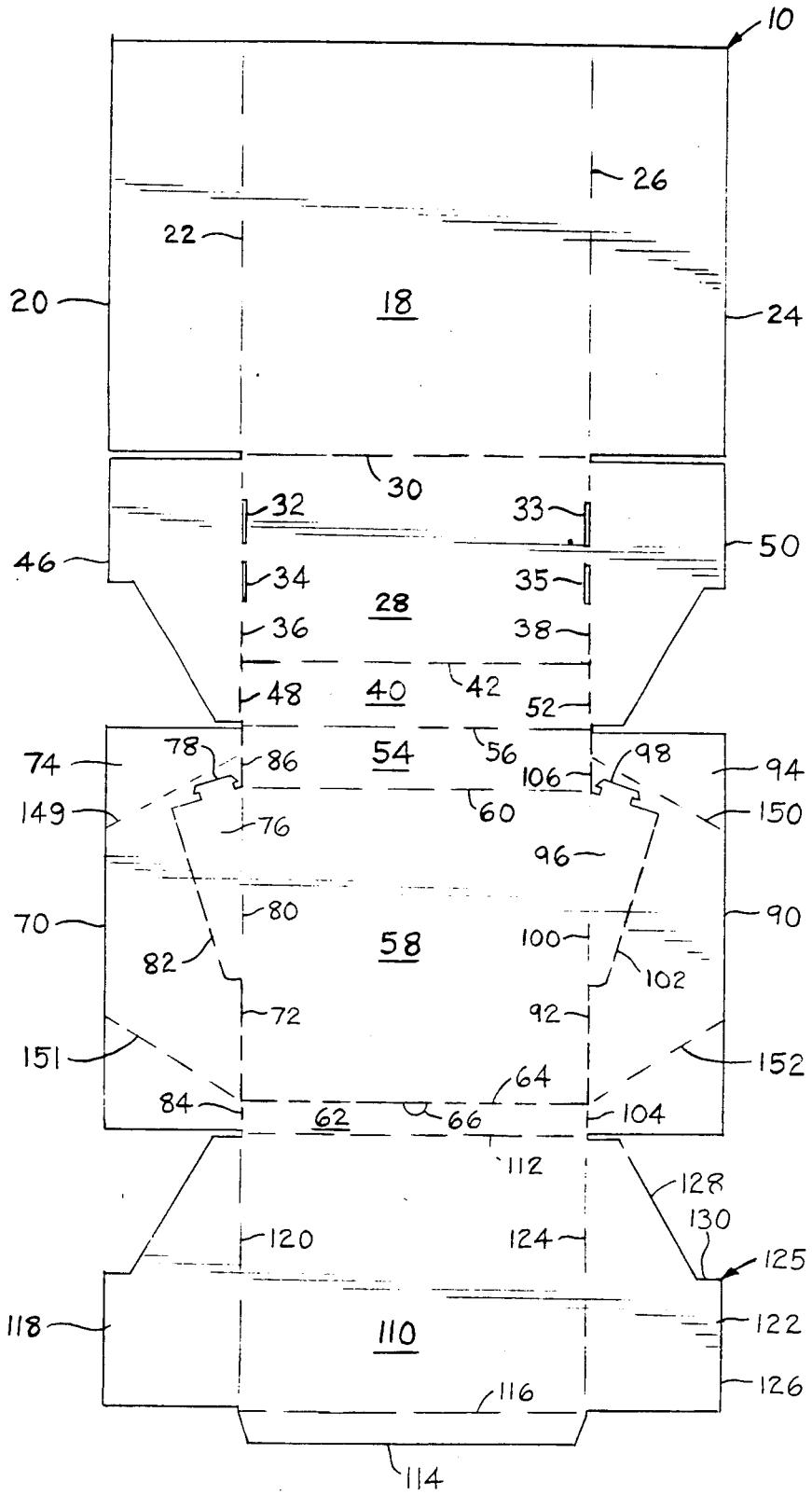
FIG. 1 is a plan view of a blank or web of a display carton in accordance with principles of the present invention.
Figure 2:
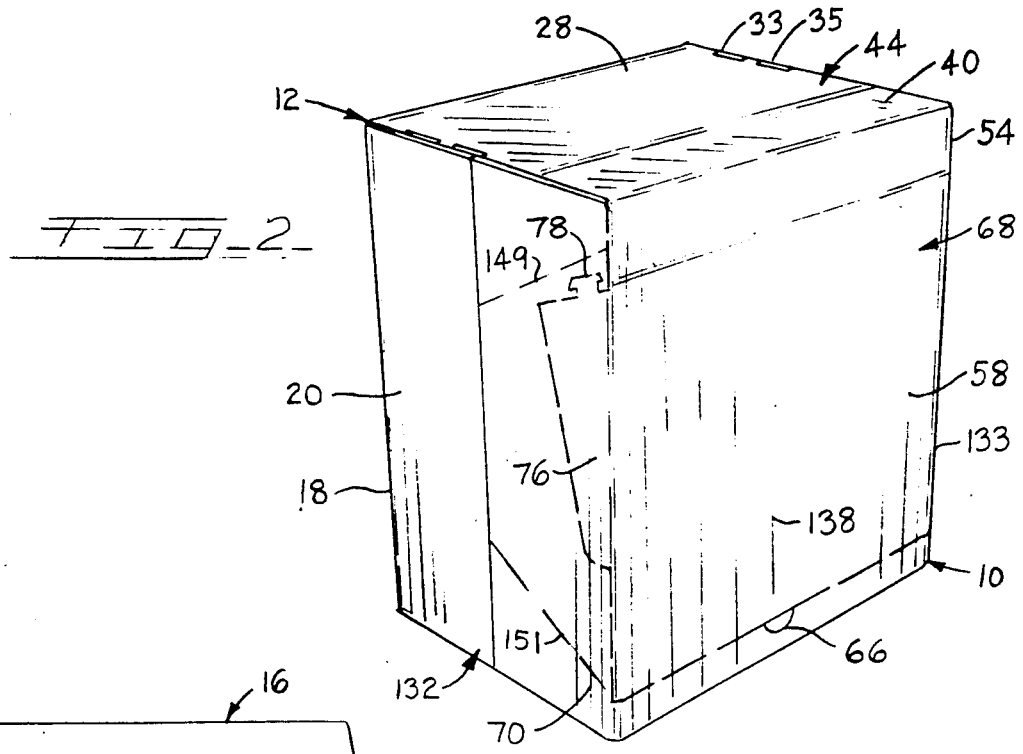
FIG. 2 is a perspective view of the display carton in a closed shipping and storage position.
Figure 3:
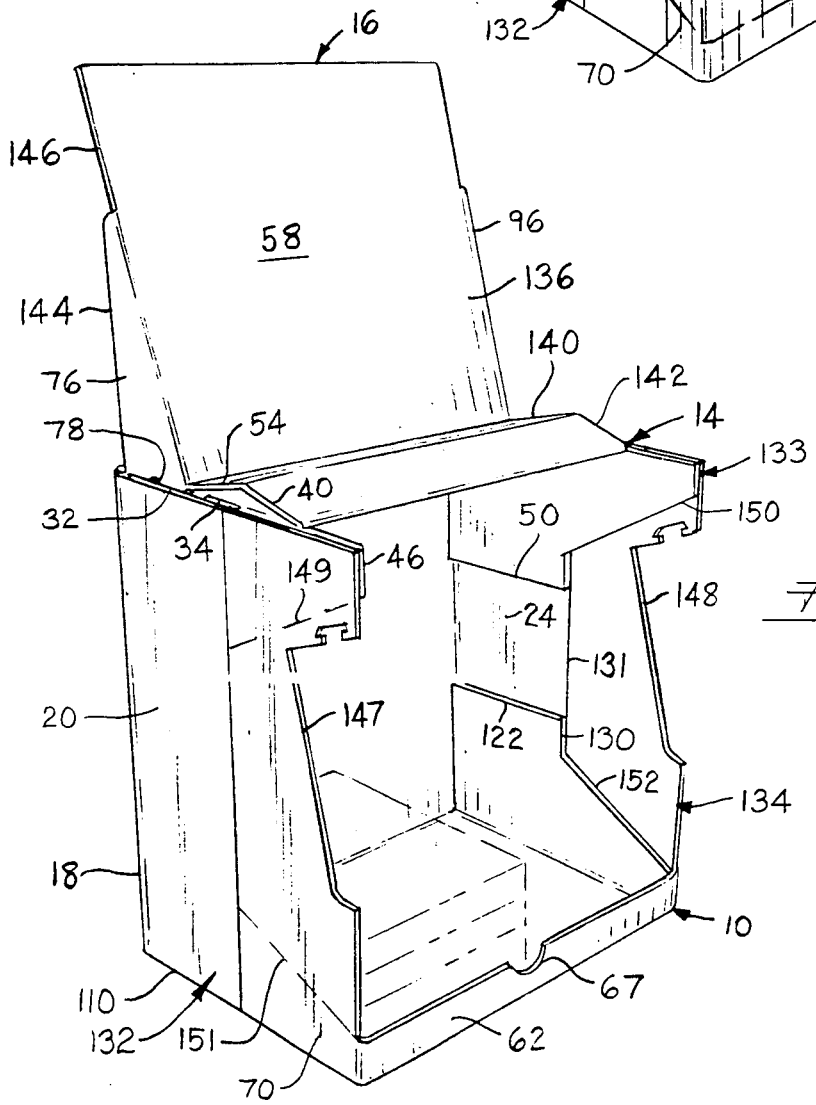
FIG. 3 is a perspective view of the display carton in an open display position, with the display stand extending upwardly.

Referring to FIGS. 1 and 2 of the drawings, a corrugated cardboard container provides a strong, sturdy display carton 10. The display carton provides a secure box 12 as shown in FIG. 2 for shipment and storage of merchandise (products or produce) and an attractive display case 14 as shown in FIG. 3 for displaying merchandise shipped in the box. The display case has an upright, display stand 16 which extends above the top of the box to securely support and display some of the merchandise. The display stand, which is also sometimes referred to as a display rack or easel, is steady, sturdy and dependable.

The shipping container (display carton) is preferably made of corrugated cardboard for best results. Paperboard or other materials can be used, if desired.

As best shown in the blank or web of the carton (container) in FIG. 1, the carton has a rectangular, back panel 18 which provides an upright back end wall of the carton. A rectangular, rearward left side flap 20 is integrally hinged and connected along a left, back, vertical score line 22 to the left side of said back panel 18 to provide a rearward portion of a left side wall of the carton. A rectangular, rearward right side flap 24 is integrally hinged and connected along a right, back, vertical score line 26 to the right side of said back panel 18 to provide a rearward portion of a right side wall of the carton. The rearward side flaps are the same size. The vertical score lines are parallel.

A rectangular top panel 28 is integrally hinged and connected along a horizontal score line 30 to the top of said back panel 18. The top panel has a rearward set or a forward set of elongated rectangular openings 32 and 33, or 34 and 35, along parallel score lines 36 and 38. The rectangular openings provide locking tab-receiving holes. The top panel has the same width as the back panel 18. Parallel score lines 36 and 38 and in alignment with vertical score lines 22 and 26, respectively.

A rectangular, upper panel 40 is integrally hinged and connected along a horizontal score line 42 to the front of the top panel 28. The upper panel is smaller than but has the same lateral width as the top panel. As shown in FIG. 2, the upper panel cooperates and is positioned in coplanar alignment with the top panel during shipment to provide a top lateral wall 44 for said carton, shipping container, and box.

As shown in FIG. 1, an upper left, transverse glue flap 46 is integrally hinged and connected along the left vertical score line 36 to the left side of the top panel 28 and detachably connected along a left vertical, perforation line 48 to the left side of the upper panel 40. An upper right, transverse glue flap 50 is integrally hinged and connected along the right vertical score line 38 to the right side of the top panel 28 and detachably connected along a right vertical, perforation line 52 to the right side of the upper panel 40. The perforation lines are parallel and in alignment with score lines 36 and 38, respectively.

As shown in FIGS. 1 and 2, a rectangular, forehead panel 54 is integrally hinged and connected along a horizontal score line 56 to the front of the upper panel 40. The forehead panel is about the same size as the upper panel. A rectangular, front display panel 58 is integrally hinged and connected along a horizontal score line 60 to the bottom of the forehead panel 54. The front display panel is substantially larger than the forehead panel. A rectangular chin panel 62 is detachably connected along a horizontal perforation line 64 to the bottom of the front display panel. The chin panel is substantially smaller than the front display panel. The chin panel, front display panel, and forehead panel are approximately the same width. The chin panel can have a removable semicircular knockout 66 (FIG. 1–3), extending downwardly from the center of the horizontal perforation line, to provide a finger hole and access opening 67 (FIG. 3) when the semicircular knockout is removed, in order to facilitate grasping and detaching the front panel when the carton is changed to a display case as shown in FIG. 3.

In the shipping and storage container of FIG. 2, the front display panel is positioned generally flat and in coplanar alignment with the forehead panel and the chin panel and cooperates with the forehead panel and chin panel to provide the front end wall 68 of the carton, container, and box.

Extending from the left side of the front wall, is a rectangular, forward, left side flap 70 (FIGS. 1 and 2). The forward left side flap is integrally hinged and detachably connected along the left front vertical perforation line 72 to the left side of the front wall. The forward left side flap provides a forward portion of the left side wall and is about the same size as the rearward left side flap 24. The forward left side flap has a right main body portion 74 and a generally triangular-shaped left ear 76 with a left locking tab 78. The left ear is integrally hinged and connected along a left, front, vertical score line 80 to the left side of an upper portion of the front display panel and detachably connected along an ear-shaped, left perforation line 82 to the left main body portion. The left main body portion is integrally hinged and connected along a lower left, front, vertical score line 84 to the left side of the chin panel. The left main body portion is detachably connected along an upper left, front, perforation line 86 to the left side of the forehead panel, and along the ear-shaped, left perforation line 82 to the left ear, as well as along the lower left, front perforation line 72 to the lower portion of the front display panel.

Extending from the right side of the front wall, is a rectangular, forward, right side flap 90. The forward right side flap is integrally hinged and detachably connected along the right front vertical perforation line 92 to the right side of the front wall. The forward right side flap provides a forward portion of the right side wall and is about the same size as the rearward right side flap 24. The forward right side flap has a right main body portion 94 and a generally triangular-shaped right ear 96 with a right locking tab 98. The right ear is integrally hinged and connected along a right, front, vertical score line 100 to the right side of an upper portion of the front display panel and detachably connected along an ear-shaped, right perforation line 102 to the right main body portion. The right main body portion is integrally hinged and connected along a lower right, front, vertical score line 104 to the right side of the chin panel. The right main body portion is detachably connected along an upper right, front, perforation line 106 to the right side of the forehead panel, and along the ear-shaped, right perforation line 102 to the right ear, as well as along the lower right, front perforation line 92 to the lower portion of the front display panel.

A rectangular bottom panel 110 is integrally hinged and connected along a bottom, forward horizontal score 112 line to the bottom of said chin panel 62. The bottom panel provides the bottom lateral wall of said carton, container, and box. An elongated generally trapezoidal-shaped glue flap 114 is integrally hinged and connected along a bottom, rearward, horizontal score line 116 to the bottom of the bottom panel. The bottom panel is glued or otherwise fixedly secured to the bottom inner surface of said back wall 18.

A lower left, transverse glue flap 118 is integrally hinged and connected along a left, bottom horizontal score line 120 to the left side of the bottom wall. A lower right, transverse glue flap 122 is integrally hinged and connected along a right, bottom horizontal score line 124 to the right side of the bottom wall. The transverse glue flaps 118, 120, 46 and 50 are generally foot-shaped and similar in size. Each of the transverse glue flaps has a rectangular-shaped ankle portion 125 with a transverse outer edge 126 spanning approximately the same distance as the lateral width of said forward and rearward flaps. The ankle portion has a slanted edge 128 which extends at an angle of inclination ranging from about 45 degrees to about 75 degrees and has a front edge 130 which is aligned with the edges 131 (FIG. 3) of the left or right side flaps. In the illustrative embodiment, the slanted edges are positioned at an angle of about 60 degrees relative to the transverse outer edges.

When the box is assembled, the right glue flaps are positioned transversely across and secured to the right side flaps and the left glue flaps are positioned transversely across and secured to the left side flaps. The outer surfaces of the glue flaps are glued or fastened to the inner, inwardly-facing, surfaces of the side flaps.

As shown in FIGS. 2 and 3, when properly assembled and fastened to each other, the left side flaps and left glue flaps form the left side wall 132 of the shipping box, container, and display case, and the right side flaps and right glue flaps form the right side wall 133 of the shipping box, container, and display case.

In order to efficiently and aesthetically display the merchandise in the box at a store, without the use of a separate exterior display stand, rack or bin, the front display panel, forehead panel, upper panel, and ears are partially detachable from the box to provide an attractive, sturdy display stand 16 (FIG. 3). The display stand extends upwardly from the top panel of the display case 14 and when detached from the front wall of the box provides an access opening and window 134 for viewing the contents inside the display case.

When the carton and display stand are in the open display position as shown in FIG. 3, the inner support surface 136 of the front display panel provides a back support portion to support and display some of the merchandise that was shipped in the box. The inner support surface can have a sign, advertisement, promotional material, pricing information, product descriptions, writing, or other indicia printed thereon. When the carton and stand are in the closed shipment position as shown in FIG. 2, the outer exterior surface 138 of the front display panel provides a barrier portion which blocks and prevent access and viewing through the opening and window of the front wall of the box.

As shown in FIG. 3, the forehead panel 54 of the display stand provides a rearward support ledge 140 which extends forwardly at an upward angle of inclination from the bottom of the front panel of the display case. The rearward support ledge carries and help support merchandise on the display stand.

The upper panel 40 of the display stand provides a forward ledge and lip 142 which extends forwardly of the rearward support ledge at a downward angle of inclination. The top of the lip is integrally hinged and connected to the rearward support ledge. The bottom of the lip is integrally hinged and connected to the top panel of the display stand. Writing or other indicia can be printed on the lip.

Figure 4:
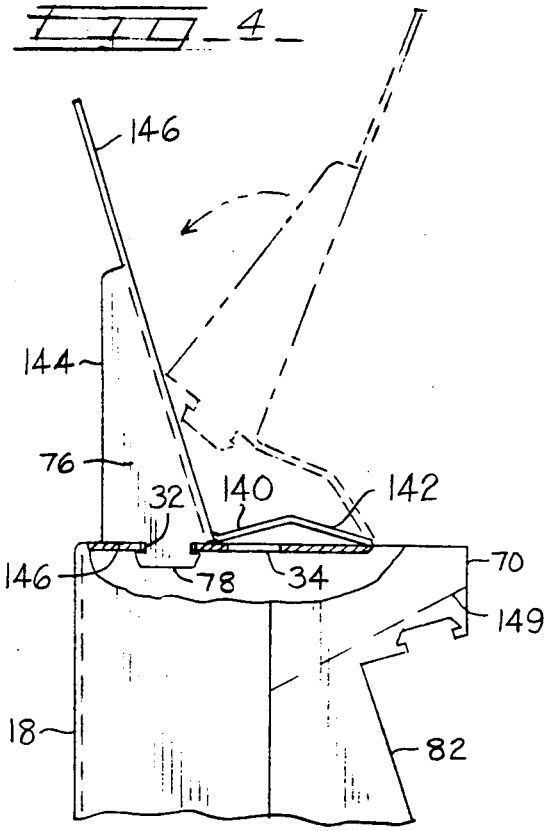
FIG. 4 is a cross-section fragmentary view of the display stand positioned in a rearward slot of the display case and showing the display stand in dotted or phantom line preparatory to be secured in the rearward slot of the display case.
Figure 5:
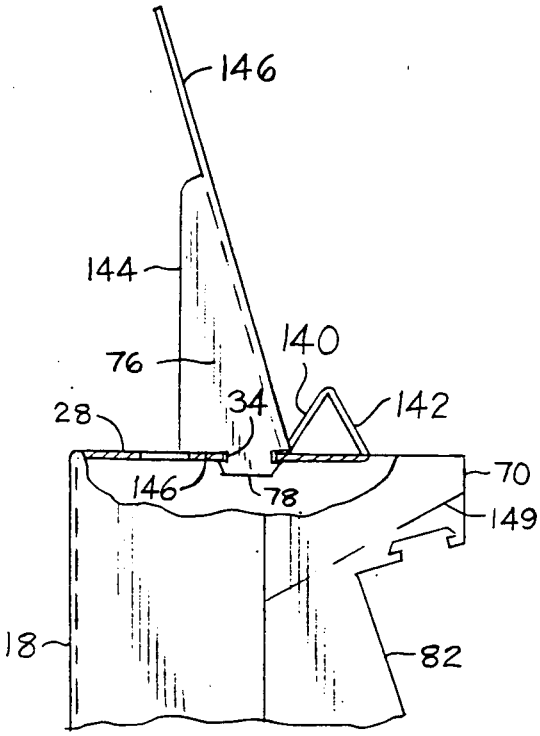
FIG. 5 is a cross-sectional fragmentary view of the display stand positioned in a forward slot of the display case.
Figure 6:
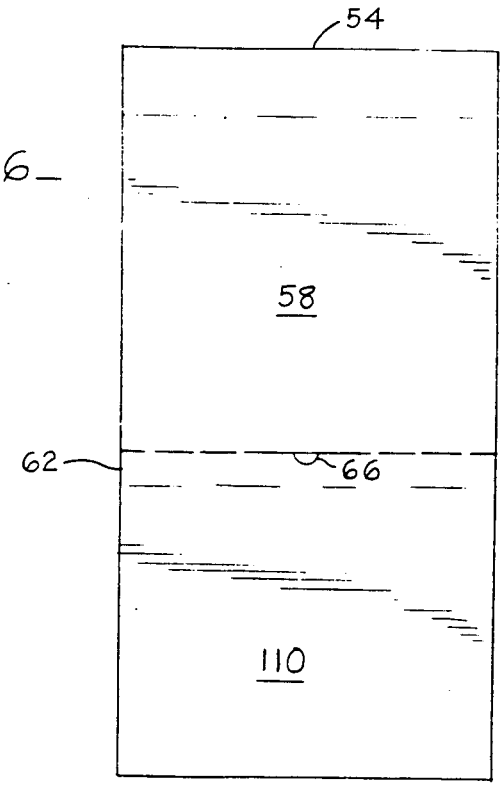
FIG. 6 is a top plan view of the display carton in a folded collapsed position.

The ears 76 and 96 provide support legs and sides of the display stand to support the front display panel at a rearward angle of inclination. The locking tabs 78 and 98 of the ears are inserted into and lockably engage the locking tab-receiving holes 32 and 33, or 34 and 35, to securely fasten and lock the support legs of the display stand to the top panel of the display case. When the locking tabs are inserted into and lockably engage the rearward set of locking tab-receiving holes 32 as shown in FIG. 4, the included angle between the rearward and forward ledges is an obtuse angle. When the locking tabs are inserted into and lockably engage the optional forward set of locking tab-receiving holes 34 as shown in FIG. 5, the included angle between the rearward and forward ledges is an acute angle.

Most preferably, there is only one set of locking tab-receiving holes to enhance the structural strength, rigidity, and mechanical integrity of the carton and display case. The set of locking tab-receiving holes can be positioned in accordance with the preference of the customer to attain the desired angle of inclination of the display panel. While one set of locking tab-receiving holes is preferred for best results, it may be desirable in some circumstances to include one or more additional sets of locking tab-receiving holes or knockouts therefore, although the strength of the box will be somewhat reduced.

In the illustrative embodiment, the elongated upright edges 144 (FIGS. 3–5) of the support legs (ears) are positioned at an angle of about 15 to 30 degrees relative to the outer edges of the display panel and the top panel-engaging bottom edges 146 of the support legs, adjacent the locking tabs, are perpendicular to the upright edges of the support legs, so that the display panel is positioned at a rearward angle of inclination of about 60 to 75 degrees relative to the vertical axis. While these angles are preferred, in some circumstances it may be desirable to use other angles.

If desired, the central middle knockout sections 147 and 148 (FIG. 3) of the main body portions of the forward side flaps can be detached from optional slanted perforation lines 149–152 and removed from the display case, to provide a larger opening and window through the sides of the display case for viewing the contents inside the display case. In the illustrative embodiment, the slanted perforation lines are at an angle of inclination of about 30 degrees relative to the vertical axis and edges of the side flaps and are aligned in registration with the slanted edges of the glue flaps. The knockout sections are generally trapezoidal in shape.

In use, the carton is assembled to from a box-like shipping container as shown in FIG. 2 for shipment and storage of merchandise. When the container arrives at the store, the display panel, forehead panel, and ears are detached from the container and pivoted upwardly to form an attractive display case with a front window (opening) and an upwardly extending display stand as shown in FIG. 3. Merchandise shipped in the container is neatly stacked and attractively displayed upon the display stand.

Among the many advantages of the display carton are:

1. Improved transport and display.
2. Economical to manufacture.
3. Cost effective.
4. Savings of storage, shelf space, and material.
5. Decreased labor expenses.
6. Less labor and supervision.
7. Easy to use, install, ship, and unpack.
8. Better market appeal.
9. An attractive display case.
10. Greater versatility.
11. Superior mass merchandising.
12. Safe.
13. Sturdy
14. Stable.
15. Strong.
16. Dependable.

Although an embodiment of the invention has been shown and described, it is to be understood that various modifications and substitutions, as well as rearrangements of parts, can be made by those skilled in the art without departing from the novel spirit and scope of this invention.

What is claimed is:

1. A display carton, comprising:

a box-like shipping container having a set of walls including a top wall, a bottom wall, a front end wall, a back end wall, and side walls, said top wall including a substantially rectangular top panel hingeably connected to said back end wall and a substantially rectangular upper panel hingeably connected to said top panel, said top panel defining locking tab-receiving holes, said upper panel having substantially the same lateral width as said top panel and being in substantial coplanar relationship with said top panel during shipment of said carton;

said front end wall having a substantially rectangular forehead panel hingeably connected to said upper panel and a substantially rectangular display panel hingeably connected to said forehead panel, said forehead panel being substantially similar in size to said upper panel and substantially smaller than said display panel, said display panel having substantially the same lateral width as said forehead panel and being in substantially coplanar relationship with said forehead panel during shipment of said carton;

each of said side walls having an ear hingeably connected to said display panel, said ear having a locking tab;

said upper panel, forehead panel, display panel, and said ears being pivotable from a normally closed shipment position substantially blocking access into the interior of said container to an open display position with said locking tabs lockably engaging said locking tab-receiving holes of said top panel, said display panel and said forehead panel cooperating with said upper panel and ears for supporting said displaying at least some of the merchandise shipped in said container in said open display position, said front end wall in said open display position defining an access opening for viewing any remaining merchandise in said container, and said forehead panel in said open display position comprising a ledge having substantially the same lateral width as said display panel, said ledge extending laterally across and forwardly from said display panel at an upward angle of inclination for carrying and helping to support merchandise on said display panel.

2. A display carton in accordance with claim 1 wherein said display panel, forehead panel, upper panel, and ears cooperate with each other to comprise a display stand in said open display position.

3. A display carton, comprising:

a corrugated cardboard container providing a box for shipment of products and a display case for displaying products shipped in said box, said container comprising a substantially rectangular, back panel providing an upright back wall of said container;

a substantially rectangular, rearward left flap hingeably connected to the left side of said back panel to provide a rearward portion of a left side wall of said container;

a substantially rectangular, rearward right flap hingeably connected to the right side of said back panel to provide a rearward portion of a right side wall of said container;

a substantially rectangular top panel hingeably connected to the top of said back panel, said top panel defining locking tab-receiving holes;

a substantially rectangular, upper panel hingeably connected to the front of said top panel, said upper panel being substantially smaller than but having substantially the same lateral width as said top panel, said upper panel cooperating and being in substantial coplanar relationship with said top panel during shipment to provide a top wall for said container;

an upper left, transverse glue flap hingeably connected to the left side of said top panel and detachably connected to the left side of said upper panel;

an upper right, transverse glue flap hingeably connected to the right side of said top panel and detachably connected to the right side of said upper panel;

a substantially rectangular, forehead panel hingeably connected to the front of said upper panel and being substantially similar in size to said upper panel;

a substantially rectangular, front display panel hingeably connected to the bottom of said forehead panel, said front display panel being substantially larger than said forehead panel;

a substantially rectangular, chin panel detachably connected to the bottom of said front display panel, said chin panel being substantially smaller than said front display panel;

said chin panel, front display panel, and forehead panel being of substantially the same width;

said front display panel cooperating and being in substantially coplanar relationship with said forehead panel and said chin panel during shipment to provide a front wall of said container;

a substantially rectangular, forward left flap hingeably connected to the left side of said front wall to provide a forward portion of said left side wall, said forward left side flap being substantially the same size as said rearward left flap, said forward left flap having a left main body portion and a generally triangular-shaped left ear with a left locking tab, said left ear being hingeably connected to the left side of an upper portion of said front display panel and detachably connected to said left main body portion, said left main body portion being hingeably connected to the left side of said chin panel and detachably connected to the left side of said forehead panel, said left ear and the lower portion of said front display panel;

a substantially rectangular, forward right flap hingeably connected to the right side of said front wall to provide a forward portion of said right side wall, said forward right side flap being substantially the same size as said rearward right flap, said forward right flap having a right main body portion and a generally triangular-shaped right ear with a right locking tab, said right ear being hingeably connected to the right side of an upper portion of said front display panel and detachably connected to said right main body portion, said right main body portion being hingeably connected to the right side of said chin panel and detachably connected to the right side of said forehead panel, said right ear and the lower portion of said front display panel;

a substantially rectangular, bottom panel hingeably connected to the bottom of said chin panel and providing a bottom wall of said container;

an elongated generally trapezoidal-shaped glue flap hingeably connected to the bottom of said bottom panel and fixedly secured and glued to the bottom inner surface of said back wall;

a lower left, transverse glue flap hingeably connected to the left side of said bottom wall;

a lower right, transverse glue flap hingeably connected to the right side of said bottom wall;

said lower and upper left, transverse glue flaps extending transversely across and being fixedly secured and glued to upper and lower inwardly-facing portions of said forward and rearward left flaps and cooperating with said forward and rearward left flaps to provide said left side wall of said container;

said lower and upper right, transverse glue flaps extending transversely across and being fixedly secured and glued to upper and lower inwardly-facing portions of said forward and rearward left flaps and cooperating with said forward and rearward right flaps to provide said right side wall of said container;

said front display panel, forehead panel, upper panel, and ears being partially detachable from said container to define an access opening and window in said display case for viewing the products in said display case and cooperating with each other to provide a display stand extending upwardly from said top panel of said display case; and said display stand comprising said front display panel for supporting and displaying products shipped in said box;

said forehead panel comprising a ledge extending forwardly at an upward angle of inclination from the bottom of said front display panel of said display case for carrying and helping to support said products on display on said display stand;

said upper panel comprising a lip hingeably connected to and extending forwardly of said ledge at a downward angle of inclination and hingeably connected to said top panel of said display stand;

said ears comprising said support legs and sides of said display stand for supporting said front display panel at a rearward angle of inclination; and said locking tabs lockably engaged in said locking tab-receiving holes to secure said support legs of said display stand to said top panel of said container.

4. A display carton in accordance with claim 3 wherein said transverse glue flaps are generally foot-shaped and similar in size.

5. A display carton in accordance with claim 4 wherein said transverse glue flaps have a substantially rectangular-shaped ankle portion with a transverse outer edge spanning substantially the same distance as the width of said forward and rearward flaps.

6. A display carton in accordance with claim 5 wherein said transverse glue flaps have a slanted edge extending from said ankle portion at an angle of inclination ranging from about 45 degrees to about 75 degrees.

7. A display carton in accordance with claim 5 wherein said main body portion includes a knockout section having detachable edges aligned with said slanted edges of said transverse glue flaps.

* * * * *